US008660272B2

(12) United States Patent
Kumagai

(10) Patent No.: US 8,660,272 B2
(45) Date of Patent: Feb. 25, 2014

(54) PARAMETER SETTING METHOD AND AUDIO APPARATUS

(75) Inventor: Kunihiro Kumagai, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 307 days.

(21) Appl. No.: 13/075,513

(22) Filed: Mar. 30, 2011

(65) Prior Publication Data

US 2011/0243340 A1 Oct. 6, 2011

(30) Foreign Application Priority Data

Mar. 31, 2010 (JP) ..... 2010-082457

(51) Int. Cl.
*H04R 29/00* (2006.01)
*H04R 3/02* (2006.01)

(52) U.S. Cl.
USPC ..... 381/58; 381/59; 381/97; 381/93; 381/95; 381/96

(58) Field of Classification Search
USPC ..... 381/58, 59, 92, 97, 98, 93, 95, 96
See application file for complete search history.

(56) References Cited

U.S. PATENT DOCUMENTS 5,386,465 A * 1/1995 Addeo et al. ..... 379/202.01
2006/0177074 A1* 8/2006 Ko ..... 381/63
2011/0081023 A1* 4/2011 Raghuvanshi et al. ..... 381/17

FOREIGN PATENT DOCUMENTS

JP 60-223295 A 11/1985
JP 5-49098 A 2/1993

* cited by examiner

*Primary Examiner* — Duc Nguyen
*Assistant Examiner* — George Monikang
(74) *Attorney, Agent, or Firm* — Crowell & Moring LLP

(57) ABSTRACT

A method of setting a parameter for an audio apparatus including a delay processing unit which applies a delaying process and an amplifying process on an input audio signal in accordance with the set parameter, includes: performing a measuring process including: causing an outputting device to output measurement sound; and measuring a first impulse response at a sound receiving point; performing a specifying process including: analyzing the measured first impulse response; calculating a second impulse response at the sound receiving point when the outputting device outputs sound in case where a parameter is set in the audio apparatus and an audio signal indicative of the measurement sound is input to the audio apparatus; and specifying a parameter in accordance with the calculated second impulse response; and performing a setting process of setting the specified parameter in the delay processing unit.

10 Claims, 6 Drawing Sheets

PARAMETER SETTING METHOD AND AUDIO APPARATUS

BACKGROUND OF THE INVENTION

The present invention relates to a technique for reducing the influence of indirect sound which is output by a speaker and which reaches the listener after being reflected from a wall of a room or the like.

Sound output by a speaker directly reaches the sound receiving point where the listener is located, and further indirectly reaches the point after being reflected from a wall surface of a room or the like. The indirect sound which indirectly reaches the point is mixed with the direct sound which directly reaches the point, so that the listener listens to sound which is different from the sound that is actually output by the speaker. Particularly, indirect sound which, after direct sound reaches, reaches with being delayed by a time period that is shorter than the auditory temporal resolution is heard not as reverberant sound in the room, but as sound in which the quality is changed. In order to reduce the influence which is exerted on the quality of such indirect sound at the sound receiving point, therefore, a technique for applying a correcting process on sound output by a speaker has been developed (for example, JP-A-5-49098 and JP-A-60-223295).

A configuration which performs a correcting process as in JP-A-5-49098 and JP-A-60-223295 requires an FIR (Finite Impulse Response) filter. When an FIR filter is used, an accurate control is enabled, but the computational complexity is increased. When the sampling frequency is high, particularly, the computational complexity is very large.

SUMMARY

It is therefore an object of the invention to reduce the influence of indirect sound which is exerted on the sound quality, by using a configuration that is simpler than an FIR filter.

In order to achieve the object, according to the invention, there is provided a method of setting a parameter for an audio apparatus, the audio apparatus including: a delay processing unit which applies a delaying process and an amplifying process on an input audio signal in accordance with the set parameter and which outputs a processed audio signal; and an adding unit which adds the audio signal output from the delay processing unit to the input audio signal and which outputs an added audio signal to an outputting device that outputs, as sound, the audio signal output from the adding unit, the method comprising: performing a measuring process including: causing the outputting device to output measurement sound; and measuring a first impulse response at a sound receiving point; performing a specifying process including: analyzing the measured first impulse response; calculating a second impulse response at the sound receiving point when the outputting device outputs sound in case where a parameter is set in the audio apparatus and an audio signal indicative of the measurement sound is input to the audio apparatus; and specifying a parameter in accordance with the calculated second impulse response; and performing a setting process of setting the specified parameter in the delay processing unit.

In the specifying process, a plurality of second impulse responses may be calculated in case where a plurality of parameters, which have different values from each other, are respectively set in the audio apparatus, and one parameter may be specified from the plurality of parameters in accordance with the plurality of second impulse responses.

The audio apparatus may further include an extracting unit which performs, to the audio signal which is to be added to the input audio signal, a process of extracting and outputting a component of a frequency band that is equal to or lower than a predetermined frequency band.

In the specifying process, a parameter in which energy of the second impulse response in a predetermined period is smaller than energy of the first impulse response in the predetermined period may be specified.

In the specifying process, a parameter in which a peak value of an absolute value of the second impulse response in a predetermined period is smaller than a peak value of an absolute value of the first impulse response in the predetermined period may be specified.

According to the invention, there is also provided an audio apparatus comprising: a delay processing unit which applies a delaying process and an amplifying process on an input audio signal in accordance with a parameter being set so that a maximum delay time in the delaying process is 50 msec. or shorter and which outputs a processed audio signal; an adding unit which adds the audio signal output from the delay processing unit to the input audio signal and which outputs an added audio signal; and an outputting unit which outputs, as sound, the audio signal output from the adding unit.

The audio apparatus may further include an extracting unit which performs, to the audio signal which is to be added to the input audio signal, a process of extracting and outputting a component of a frequency band of 1 kHz or less.

DETAILED DESCRIPTION OF EMBODIMENTS

<Embodiment>

[Configuration]

Figure 1:
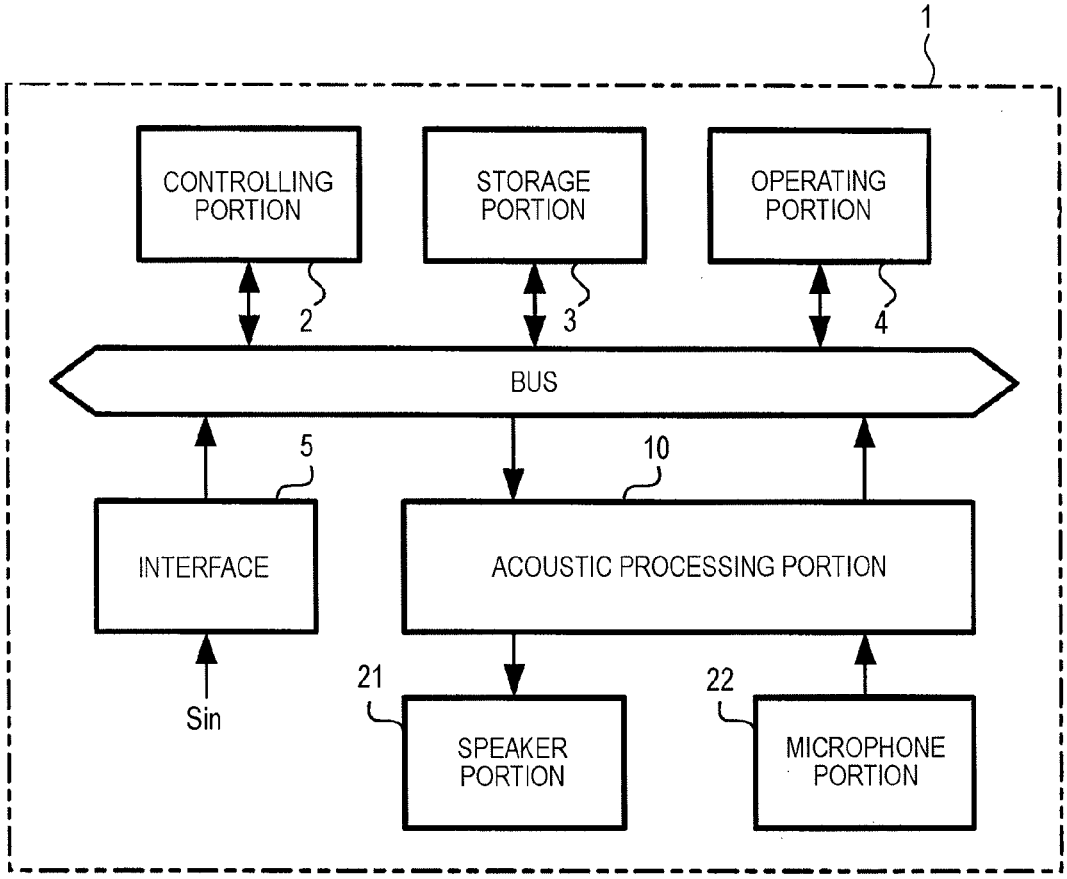
FIG. 1 is a block diagram illustrating the configuration of a speaker apparatus of an embodiment of the invention.

FIG. 1 is a block diagram illustrating the configuration of a speaker apparatus 1 of an embodiment of the invention. The speaker apparatus 1 includes a controlling portion 2, a storage portion 3, an operating portion 4, an interface 5, and an acoustic processing portion 10. These components are connected to one another through a bus. A speaker portion 21 and a microphone portion 22 are connected to the acoustic processing portion 10.

The controlling portion 2 includes a CPU (Central Processing Unit), a RAM (Random Access Memory), a ROM (Read Only Memory), and the like. The controlling portion 2 implements control programs stored in the storage portion 3 or the ROM to control various portions of the speaker apparatus 1 through the bus. For example, the controlling portion 2 controls the acoustic processing portion 10 to realize configurations for performing a correcting process and a measuring process in the acoustic processing portion 10.

The correcting process is a process which is performed in the speaker apparatus 1 in order to reduce the influence of indirect sound from sound that is output by the speaker apparatus 1 and that is heard by the listener located at the sound receiving point. The measuring process is a process which, when the controlling portion 2 performs a setting process of setting a parameter used in the correcting process, is performed in the acoustic processing portion 10. The setting process is performed when the environment such as the installation position of the speaker apparatus 1, the room in which the speaker apparatus is installed, or the sound receiving point is changed. The setting process is started by an operation on the operating portion 4 by the user.

The storage portion 3 is storage means such as a nonvolatile memory, and stores the set parameter which is used in the control by the controlling portion 2, and the like. The set parameter includes the parameter which is set in the acoustic processing portion 10.

The operating portion 4 has operating means such as a volume for controlling the volume level, and operation buttons for inputting instructions for changing setting, and supplies information indicative of the operation contents to the controlling portion 2.

The interface 5 is configured by input terminals for obtaining an audio signal Sin from the outside, and the like.

Figure 2:
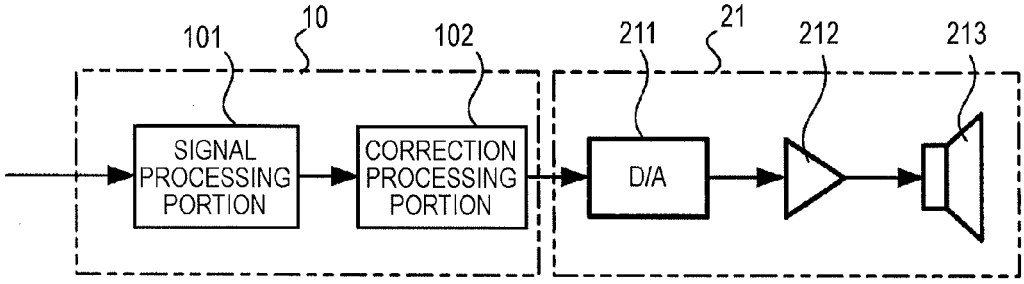
FIG. 2 is a block diagram illustrating the configuration for performing a correcting process in an acoustic processing portion in the embodiment of the invention.
Figure 4:
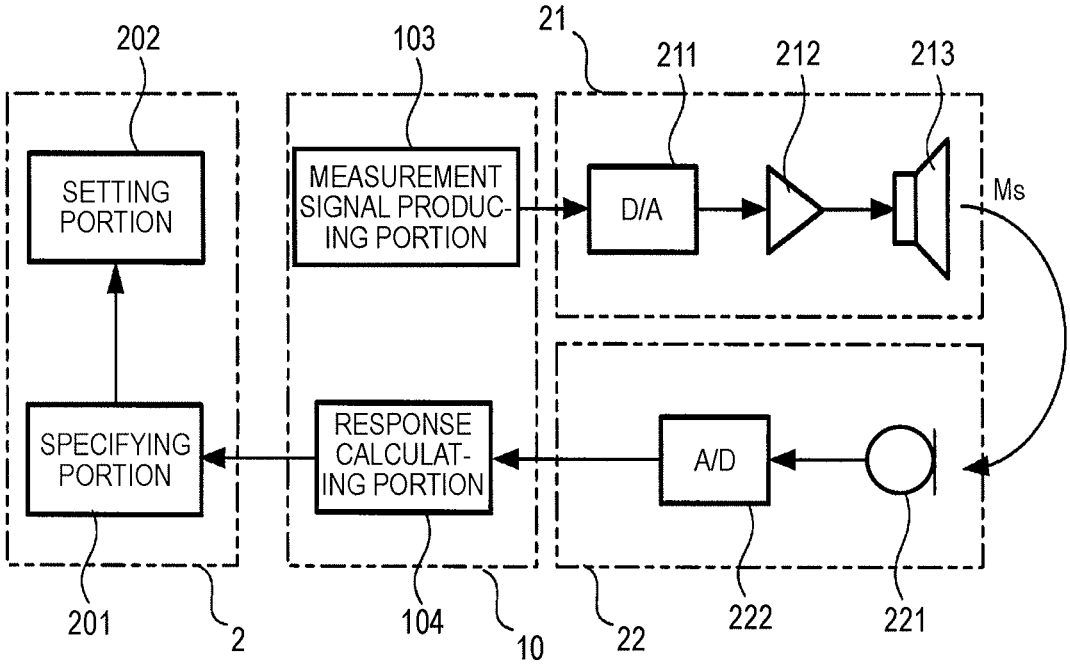
FIG. 4 is a block diagram illustrating the configuration for performing a setting process in the embodiment of the invention.

The speaker portion 21 is outputting means for outputting an input audio signal as sound, and includes: a digital/analog converting portion (D/A) 211 which converts the input digital audio signal to an analog signal, and which outputs the analog signal; an amplifying portion 212 which amplifies an input audio signal, and which supplies the amplified signal; and a speaker unit 213 which outputs an input audio signal as sound (see FIGS. 2 and 4). In the speaker portion 21, configuration sets are disposed in correspondence with the number of channels through which an output operation can be performed. In the case where the speaker portion 21 has two configuration sets, for example, the sets correspond to the L- and R-channels of the audio signal, respectively. The speaker unit 213 may not be a single speaker unit, and may be a speaker array configured by a plurality of speaker units.

The microphone portion 22 includes a microphone 221 which outputs input sound as an audio signal, and which is substantially omnidirectional, and an analog/digital converting portion (A/D) 222 which converts the input analog audio signal to a digital signal (see FIG. 4).

The acoustic processing portion 10 performs various processes on an audio signal in accordance with the control of the controlling portion 2. Next, the configuration for performing the correcting process in the acoustic processing portion 10 will be described.

[Correcting Process]

FIG. 2 is a block diagram illustrating the configuration for performing the correcting process in the acoustic processing portion 10 in the embodiment of the invention. The correcting process in the acoustic processing portion 10 is realized by a signal processing portion 101 and a correction processing portion 102.

The signal processing portion 101 obtains the audio signal Sin which is supplied to the interface 5, performs various signal processes such as a decoding process, an equalizer process, and a process of applying an acoustic effect, and outputs the resulting audio signal. The correction processing portion 102 performs the correcting process on the audio signal which is supplied from the signal processing portion 101, and outputs the processed audio signal to the speaker portion 21.

The configuration of the correction processing portion 102 will be described in detail with reference to FIG. 3.

[Configuration of Correction Processing Portion 102]

Figure 3:
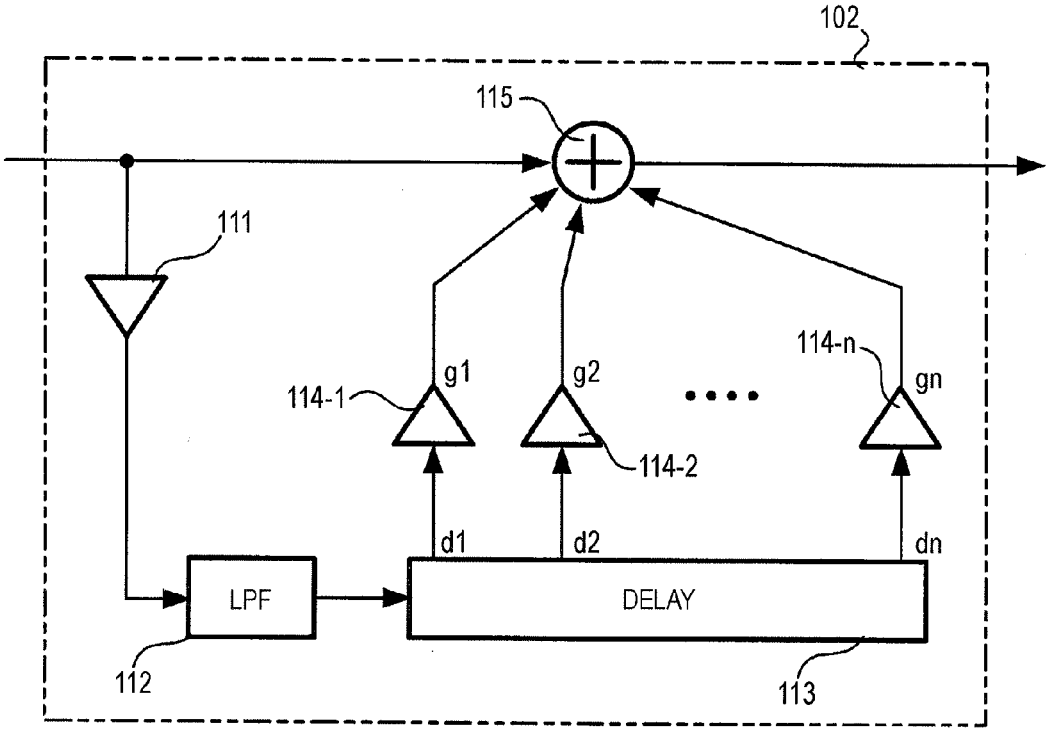
FIG. 3 is a block diagram illustrating the configuration of a correction processing portion in the embodiment of the invention.

FIG. 3 is a block diagram illustrating the configuration of the correction processing portion 102 in the embodiment of the invention. The correction processing portion 102 applies a process on the input audio signal by means of a low-pass filter (LPF) and a multi-tap delay including a plurality of delay processing portions, adds the processed signal to the original audio signal, and then outputs the resulting signal. The correction processing portion 102 has an input level adjusting portion 111, the low-pass filter 112, a delaying portion (Delay) 113 including a plurality of taps, level adjusting portions 114-1, 114-2, . . . , 114-n, and an adding portion 115. The multi-tap delay is configured by the delaying portion (Delay) 113 and the level adjusting portions 114-1, 114-2, . . . , 114-n.

The input level adjusting portion 111 amplifies the audio signal which is input to the low-pass filter 112 and the signal line of the multi-tap delay, by an amplification factor corresponding to the control of the controlling portion 2, thereby adjusting the input level of the signal. This configuration may not be disposed.

In the low-pass filter 112, the cutoff frequency Fc is set, and, in the audio signal obtained from the input level adjusting portion 111, a component of a frequency band which is higher than the cutoff frequency Fc is attenuated, whereby an audio signal which is equal to or lower than the cutoff frequency Fc is extracted to be output. In this example, the cutoff frequency Fc is set to 500 Hz (about 70 cm in terms of wavelength). Preferably, the cutoff frequency Fc is set to a frequency in which the wavelength is about several times of the size of the head of a person, preferably about 1 kHz or lower. The set value may be designated by a user's operation on the operating portion 4.

The delaying portion 113 has a plurality of delaying circuits which apply a delaying process on the audio signal supplied from the low-pass filter 112, and an n number (in this example, n=12) of signal lines connected to the taps from which signals that have been delayed by the delaying circuits are output, respectively. In the delaying portion 113, in correspondence with the signal lines (taps), delay times (d1, d2, . . . , dn) are set by the control of the controlling portion 2. The delay times are set to 50 msec. or shorter corresponding to the auditory temporal resolution. The delaying portion 113 applies delaying processes of delay times which are set in correspondence with the respective signal lines, on the input audio signal, and then outputs the delayed signals from the signal lines.

The level adjusting portions 114-1, 114-2, . . . , 114-n are disposed in correspondence with the signal output lines from the delaying portion 113. In the level adjusting portions 114-1, 114-2, . . . , 114-n, amplification factors (g1, g2, . . . , gn) are set correspondingly with the control of the controlling portion 2. The level adjusting portions 114-1, 114-2, . . . , 114-n amplify the audio signals output to the signal output lines by the amplification factors which are set in the portions, respectively, and output the amplified signals. The outputs of the level adjusting portions 114-1, 114-2, . . . , 114-n of the signal lines correspond to those from the delay processing portions of the multi-tap delay. Namely, each of the delay processing portions included in the above-described multi-tap delay is configured by the delaying circuit which applies the delaying process on the signal that is output to one of the signal lines from the delaying portion 113, and one level adjusting portion which applies the amplifying process on the signal output to the signal line.

The adding portion 115 adds the audio signals output from the level adjusting portions 114-1, 114-2, . . . , 114-n, to the original audio signal supplied to the correction processing portion 102, and outputs the resulting signal. The correction processing portion 102 is configured as described above.

Next, the setting process will be described.

[Setting Process]

FIG. 4 is a block diagram illustrating the configuration for performing the setting process in the embodiment of the invention. The measuring process in the acoustic processing portion 10 is realized by a measurement signal producing portion 103 and a response calculating portion 104. In the controlling portion 2, a specifying portion 201 and a setting portion 202 are configured. As described above, the setting process is realized by the specifying portion 201 and the setting portion 202, and the measurement signal producing portion 103 and the response calculating portion 104.

When the setting process is to be performed, the speaker unit 213 of the speaker apparatus 1 which is installed in a room is disposed at the same position as that in the case where the listener actually hears sound. In the case where the speaker portion 21 has a plurality of configuration sets, the setting process is performed correspondingly with each of the sets. In the following, description will be made assuming that the speaker portion 21 has one configuration set.

On the other hand, the microphone 221 is disposed at the sound receiving point where the listener is to be located.

The measurement signal producing portion 103 produces a measurement signal in response to the control of the controlling portion 2, and outputs the signal to the speaker portion 21. For example, the measurement signal is a signal indicating impulse sound. Therefore, the speaker portion 21 outputs measurement sound Ms indicative of the measurement signal (a measurement sound outputting process). Then, sound in which indirect sound in the room and the like are included to the measurement sound Ms is input to the microphone 221. The microphone portion 22 outputs a measurement result signal indicative of the contents of the sound which is input to the microphone 221.

The response calculating portion 104 compares the measurement result signal output from the microphone portion 22 with the measurement signal produced in the measurement signal producing portion 103, and calculates an impulse response, and measures it as an impulse response (hereinafter, referred to as measurement impulse response) at the sound receiving point (an impulse response measuring process). When the measurement signal is impulse sound, the measurement result signal is a signal indicating the measurement impulse response.

The specifying portion 201 analyzes the signal indicating the measurement impulse response, and calculates a value which is estimated as the impulse response at the sound receiving point (hereinafter, referred to as estimated impulse response) in the case where the correcting process in the correction processing portion 102 is applied on the measurement signal indicative of the measurement sound Ms, and then the signal is output to the speaker portion 21 to be output as sound from the speaker unit 213 (an impulse response measuring process). At this time, the correcting process is performed while the parameters (the delay times and the amplification factors) set in the multi-tap delay (the delaying portion 113 and the level adjusting portions 114-1, 114-2, . . . , 114-n) are changed in several manners, thereby calculating the estimated impulse response.

Then, the specifying portion 201 compares signals indicative of a plurality of estimated impulse responses which are calculated in correspondence with a plurality of parameters having different values, with one another, and specifies one parameter by which the energy of the signal is made small, from the plurality of parameters (a parameter specifying process).

Specific contents of the processes in the specifying portion 201 will be described in detail in descriptions of the respective processes.

The setting portion 202 obtains the parameter specified in the specifying portion 201, and sets it in the delaying portion 113 and level adjusting portions 114-1, 114-2, . . . , 114-n of the correction processing portion 102 (a parameter setting process).

Next, the parameter setting method in the setting process will be described with reference to FIGS. 5, 6A, and 6B.

[Parameter Setting Method]

Figure 5:
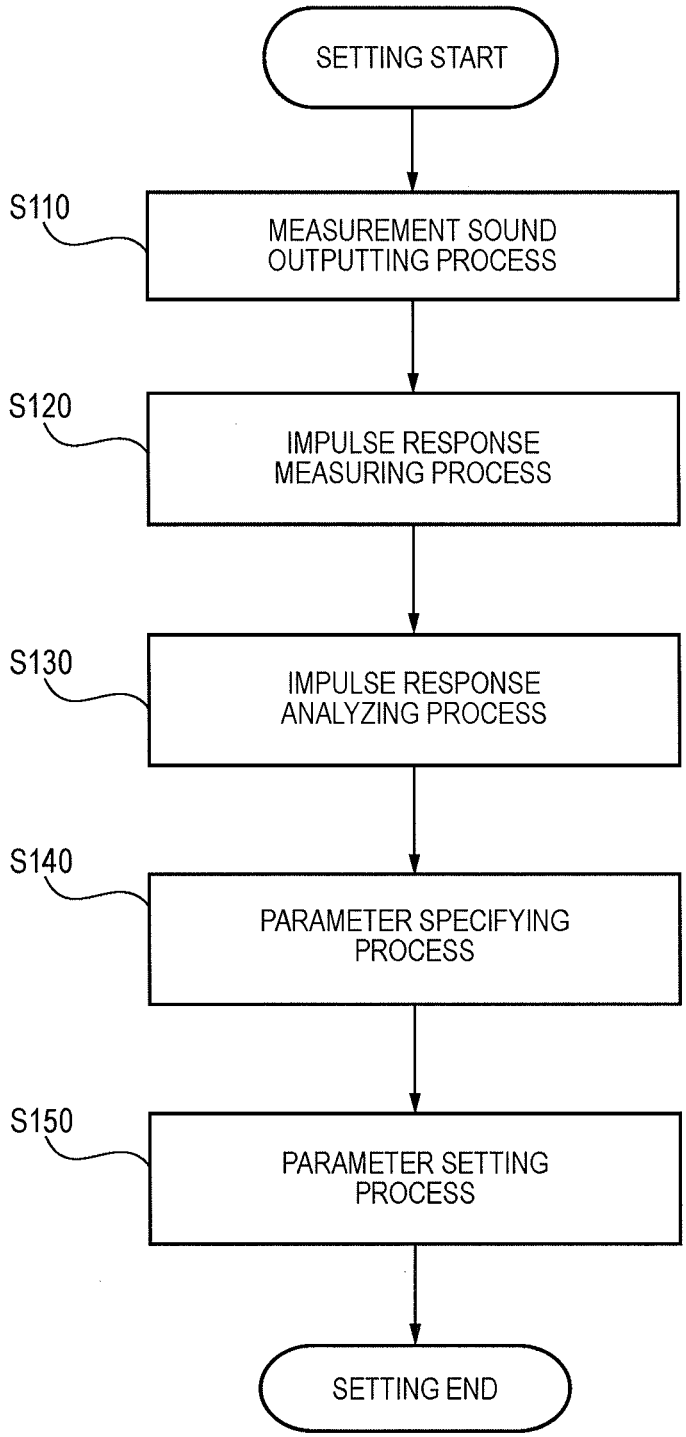
FIG. 5 is a flowchart illustrating a parameter setting method in the embodiment of the invention.

FIG. 5 is a flowchart illustrating the parameter setting method in the embodiment of the invention. When instructions for starting the setting process are issued by an operation on the operating portion 4 by the user, the speaker apparatus 1 starts the parameter setting process.

First, when the parameter setting process is started, the measurement signal producing portion 103 outputs the measurement signal in response to the control of the controlling portion 2, to cause the speaker unit 213 to output the measurement sound Ms (a measurement sound outputting process) (step S110). Then, the response calculating portion 104 compares the measurement result signal with the measurement signal, and calculates a measured impulse response at the sound receiving point (the impulse response measuring process) (step S120). Thereafter, the specifying portion 201 analyzes the measured impulse response (the impulse response analyzing process), calculates a plurality of estimated impulse responses, and specifies the parameter (the delay time and the amplification factor) in accordance with the energies of the signals of the estimated impulse responses (the parameter specifying process) (step S140). Hereinafter, the contents of the impulse response analyzing process and the parameter specifying process will be described with reference to FIGS. 6A and 6B.

Figure 6A:
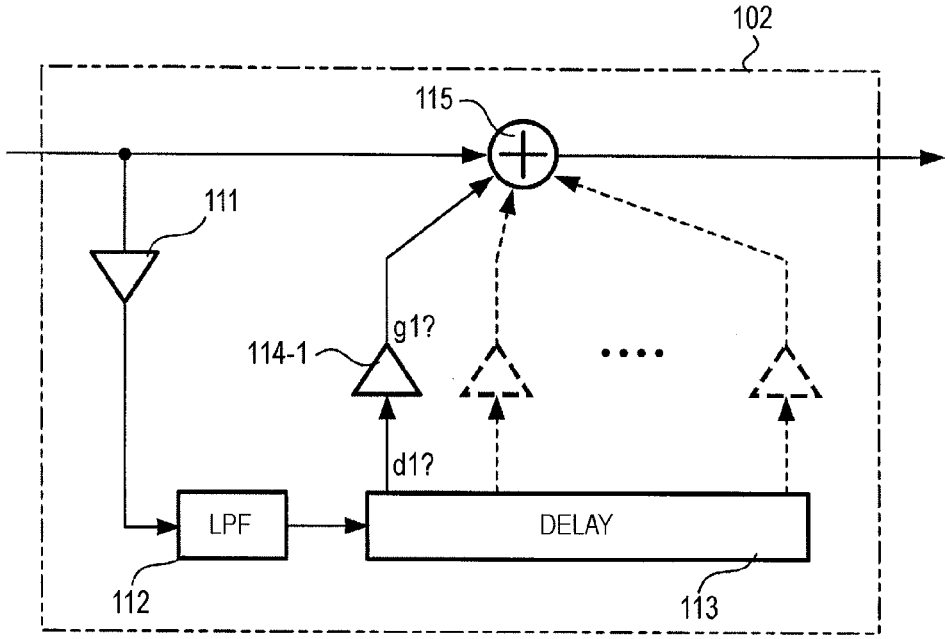
FIGS. 6A and 6B are views illustrating an example of a process in an impulse response analyzing process in the embodiment of the invention.
Figure 6B:
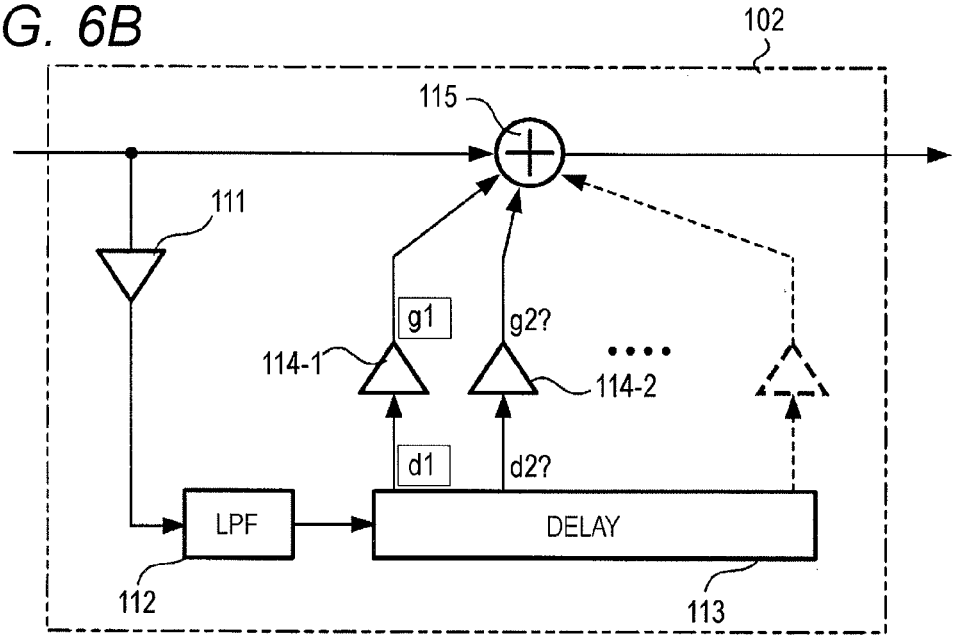

FIGS. 6A and 6B are views illustrating an example of the process in the impulse response analyzing process in the embodiment of the invention. As shown in FIG. 6A, first, the specifying portion 201 activates only the first signal line of the delaying portion 113 and the level adjusting portions 114-1, 114-2, . . . , 114-n, and inactivates the other signal lines. Here, "inactivate" means that the delaying portion 113 does not output a signal to the other signal lines, or that the amplification factors of the level adjusting portions on the other signal lines are set to "0".

Then, the specifying portion 201 applies the correcting process on the measurement signal indicative of the measurement sound Ms in the case where the delay time d1 and the amplification factor g1 are provisionally set as various values, and calculates the estimated impulse response which, when output as sound from the speaker unit 213, is estimated as the impulse response at the sound receiving point. The delay time d1 as the set parameter is provisionally set as a value which is longer than 0 msec. and equal to or shorter than 50 msec., and an available value may be, for example, in the unit of sample, or in the unit of 1 msec. The amplification factor g1 as the other parameter is provisionally set as a value which is between −x (dB) and +y (dB), and an available value may be in a predetermined unit such as in the unit of 1 dB. Also, a value which causes an inverting process may be available, Then, the specifying portion 201 compares signals indicative of a plurality of estimated impulse responses which are calculated in correspondence with a plurality of parameters (the delay time d1 and the amplification factor g1) having different values, with one another, and selects an estimated impulse response in which the energy in a predetermined evaluation period Ta is minimum. The evaluation period Ta is a period which is after a signal corresponding to direct sound in the impulse response, and its length is set to be approximately equal to or shorter than 100 msec. Preferably, the length may be set as a time period which is approximately equal to or shorter than two times of the maximum value of the delay time that is set in the above-described delaying portion 113. However, the length is not limited to this time period. In the case where the length of the evaluation period Ta is set to a time period which is long to some extent, also the stationary wave component included in the signal of the impulse response can be reduced. In this case, the specifying portion 201 may specify the frequency of the stationary wave component, and change the setting so that the cutoff frequency Fc which is set in the low-pass filter 112 is higher than the frequency of the stationary wave component.

Then, the specifying portion 201 specifies the parameter (the delay time d1 and the amplification factor g1) corresponding to the selected estimated impulse response.

As shown in FIG. 6B, next, the specifying portion 201 sets the specified parameter (the delay time d1 and the amplification factor g1) with respect to the first signal line, and fixes the values. Then, the specifying portion 201 activates the first and second signal lines, applies the correcting process on the measurement signal indicative of the measurement sound Ms in the case where the delay time d2 and the amplification factor g2 are provisionally set as various values, and calculates the estimated impulse response which, when output as sound from the speaker unit 213, is estimated as the impulse response at the sound receiving point. In the same manner as the first signal line, the specifying portion 201 calculates a plurality of estimated impulse responses, selects one estimated impulse response, and specifies the parameter (the delay time d2 and the amplification factor g2) corresponding to the selected estimated impulse response.

The specifying portion 201 repeats the above-described process, and, when the parameter which is to be set in correspondence with the n-th signal line is specified, ends the process.

Returning to FIG. 5, the description will be continued. When the process of specifying the parameters in the specifying portion 201 is ended, the setting portion 202 sets the parameters specified by the specifying portion 201 in the delaying portion 113 and the level adjusting portions 114-1, 114-2, . . . , 114-n of the correction processing portion 102 (the parameter setting process). When the setting is ended, the controlling portion 2 ends the parameter setting process. The parameter setting method is performed as described above.

Then, the difference between the impulse response at the sound receiving point in the case where the correcting process is implemented by using the correction processing portion 102 in which the parameters are set as described above, and that in the case where the correcting process is not implemented will be described with reference to FIGS. 7A to 7C.

[Comparison Between Implementation/Non-Implementation of Correcting Process]

Figure 7A:
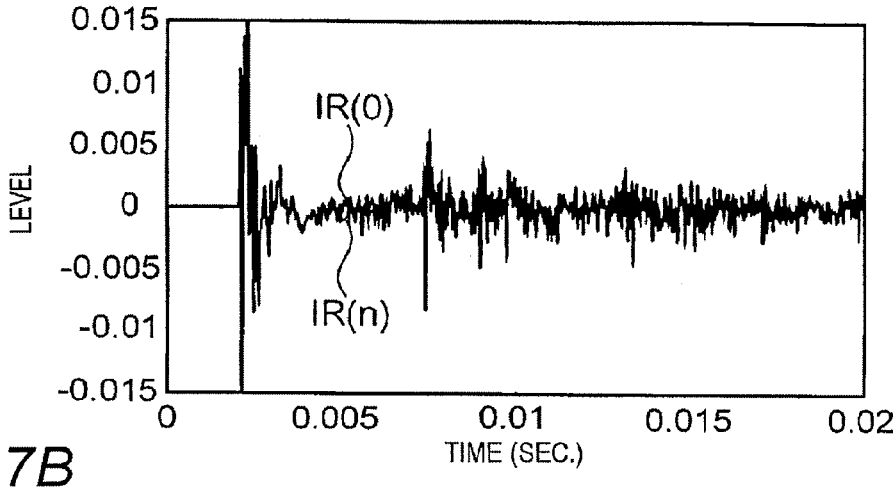
FIGS. 7A to 7C are views illustrating a difference of impulse responses due to implementation/non-implementation of the correcting process in the embodiment of the invention.
Figure 7B:
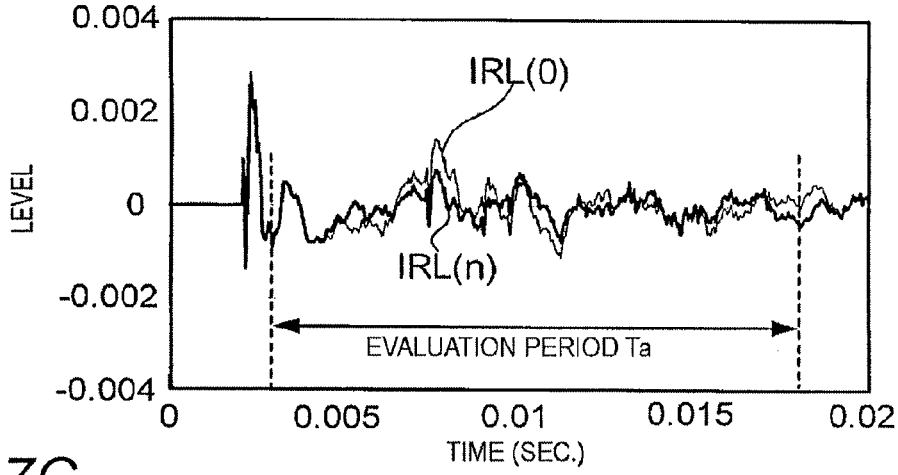
Figure 7C:
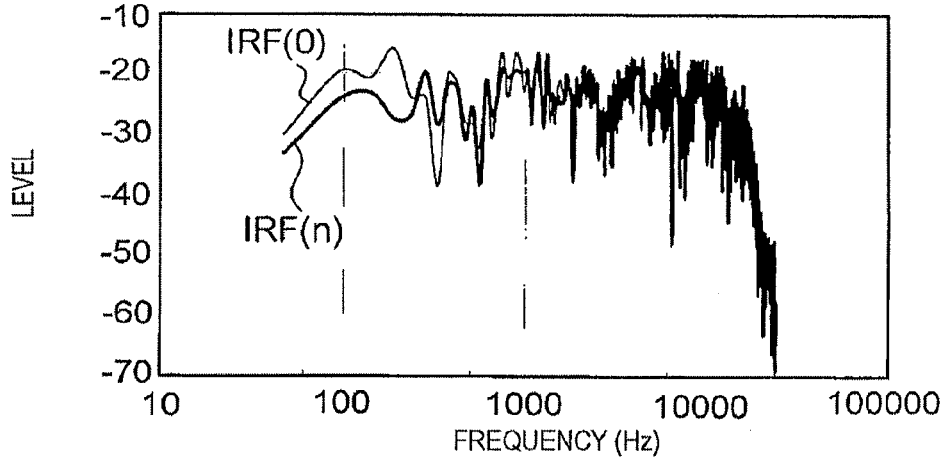

FIGS. 7A to 7C are views illustrating the difference of impulse responses due to implementation/non-implementation of the correcting process in the embodiment of the invention. In FIGS. 7A and 7B, the abscissa indicates the time while setting the time when the measurement signal is output, as "0", and the ordinate indicates the signal level. In FIG. 7C, the abscissa indicates the frequency, and the ordinate indicates the signal level.

FIG. 7A is a view in which an impulse response signal IR(0) in the case where the correcting process is not implemented is compared with an impulse response signal IR(n) in the case where, when the parameters are set by the above-described parameter setting method in a multi-tap delay having an n number of signal lines in the correction processing portion 102, the correcting process is implemented. In the figure, the signals include the component of the high-frequency band which is to be attenuated in the low-pass filter 112, and hence the difference is not clear, but the signals are slightly different from each other.

FIG. 7B is view showing impulse response signals IRL(0), IRL(n) which are obtained by extracting the frequency band that is equal to or lower than the cutoff frequency Fc (500 Hz) set in the low-pass filter 112 from the impulse response signals IR(0) IR(n) shown in FIG. 7A. When the impulse response signals IRL(0), IRL(n) are compared with each other in this way while limiting to the frequency band which is input to the multi-tap delay in the correcting process, it is clearly noted that IRL(n) is smaller than IRL(0) in the energy in the evaluation period Ta as shown in FIG. 7B. The listener hears the energy reduction as if the influence of indirect sound which reaches during the evaluation period Ta, i.e., the period that is shorter than the auditory temporal resolution is reduced. Therefore, the listener hears sound with a quality higher than that in the case where the correcting process is not implemented.

FIG. 7C is a view showing the frequency distributions of the impulse response signals IR(0), IR(n) shown in FIG. 7A in the evaluation period Ta. The spectrums showing the frequency distributions of the impulse response signals IR(0), IR(n) are indicated by IRF(0) and IRF(n), respectively. As shown in FIG. 7C, it is seen that the energy is suppressed in the low-frequency band which is passed through the low-pass filter 112.

As described above, the speaker apparatus 1 performs the correcting process on the incoming audio signal Sin, and then outputs the processed signal as sound, and therefore the listener located at the sound receiving point hears the sound in the state where the influence of indirect sound in the evaluation period Ta is reduced. In the low-frequency band which is passed through the low-pass filter 112, particularly, the influence of indirect sound is reduced. Moreover, the cutoff frequency Fc which is set in the low-pass filter 112 is set to a frequency in which the wavelength is about several times of the size of the head of a person, and hence the influence of indirect sound is reduced in the range of a distance which is approximately equal to the wavelength about the sound receiving point. In the case where the correcting process is performed by using an audio signal which is not passed through the low-pass filter 112, the correcting process is performed also on sound of the high-frequency band where the wavelength is short. When the position of the listener (the sound receiving point) is moved beyond the range of the wavelength, therefore, the correction effect in the high-frequency band is reduced, and an adverse effect is sometimes exerted on the sound quality. In such a case, when the correcting process is performed by using an audio signal which is passed through the low-pass filter 112, the effect of reducing the influence of indirect sound can be prevented from being immediately lost even when the position of the listener is slightly changed. When the listener hears indirect sound in the low-frequency band, the listener feels more strongly the influence exerted on the sound quality. Even when the effect of reducing the influence of indirect sound is not exerted in the high-frequency band, therefore, the influence exerted on the sound quality can be effectively reduced by reducing the influence of indirect sound in the low-frequency band.

<Modifications>

Although, in the above, the embodiment of the invention has been described, the invention may be implemented in various manners as described below.

[Modification 1]

In the above-described embodiment, in the specifying portion 201, the parameter is specified so that the energy of the impulse response signal IR(n) in the evaluation period Ta in the case where the correcting process is implemented is smaller than that of the impulse response signal IR(0) in the evaluation period Ta in the case where the correcting process is not implemented, thereby reducing the influence of indirect sound. Alternatively, the parameter may be specified in different manners.

In a first manner, the specifying portion 201 may specify the parameter so that the peak value of the absolute value of the impulse response signal IR(n) in the evaluation period Ta is smaller than that of the impulse response signal IR(0) in the evaluation period Ta, thereby reducing the influence of indirect sound.

In this case, when the parameter is to be specified in each signal line, the specifying portion 201 may compare signals indicative of a plurality of estimated impulse responses which are calculated in correspondence with a plurality of parameters (the delay times and the amplification factors) having different values, with one another, and select an estimated impulse response in which the maximum value of the peak value of the absolute value in the evaluation period Ta is minimum.

In a second manner, the specifying portion 201 may specify the parameter so that variation of the frequency characteristic of the impulse response signal IR(n) in the evaluation period Ta is smaller than that of the impulse response signal IR(0) in the evaluation period Ta, thereby reducing the influence of indirect sound.

In this case, when the parameter is to be specified in each signal line, the specifying portion 201 may compare signals indicative of a plurality of estimated impulse responses which are calculated in correspondence with a plurality of parameters (the delay times and the amplification factors) having different values, with one another, and select an estimated impulse response in which variation of the frequency characteristic in the evaluation period Ta is minimum.

[Modification 2]

In the above-described embodiment, the specifying portion 201 calculates a plurality of estimated impulse responses for each of the signal lines, and compares them with the measured impulse response to specify the parameter, whereby the parameter is sequentially specified for all of the signal lines. Alternatively, the parameter may be specified for a plurality one of the signal lines.

The case where the specifying portion 201 specifies the parameters for each three signal lines will be described. The three signal lines are m-th, (m+1)-th, and (m+2)-th signal lines, respectively. The specifying portion 201 calculates a plurality of estimated impulse responses in the case where parameters (the delay times dm, dm+1, dm+2 and the amplification factors gm, gm+1, gm+2) corresponding to the signal lines are provisionally set while various changing the parameters, on the premise of conditions satisfying dm<dm+1<dm+2.

Then, the specifying portion 201 compares signals indicative of a plurality of estimated impulse responses with one another, and selects an estimated impulse response in which the energy is minimum in the evaluation period Ta. Thereafter, the specifying portion 201 specifies parameters (the delay times dm, dm+1, dm+2 and the amplification factors gm, gm+1, gm+2) corresponding to the selected estimated impulse response.

In the same manner as described above, then, the specifying portion 201 specifies parameters for (m+3)-th, (m+4)-th, and (m+5)-th signal lines. The specifying portion 201 continues this process to perform specification until the parameter which is set correspondingly with the n-th signal line is obtained.

When the specifying portion 201 specifies parameters in the unit of a plurality of signal lines as described above, the energy of the impulse response signal IR(n) in the evaluation period Ta can be made smaller as compared with the case where one signal line is used as the unit. As the number of signal lines which are used as the unit for specifying parameters is larger, the energy can be made smaller, but the throughput for calculating estimated impulse responses is larger. Therefore, the specifying portion 201 may specify parameters in bundle of all of n signal lines. However, it is preferable to perform this when there is enough process time. Also during a period when the speaker apparatus 1 outputs sound which has undergone the correcting process, for example, the process in the specifying portion 201 may be performed in the background.

[Modification 3]

In the above-described embodiment, the specifying portion 201 specifies the parameter corresponding to one signal line, then specifies the parameter corresponding to the next signal line, and ends the process when the parameter corresponding to the n-th signal line is specified. Alternatively, when predetermined conditions are satisfied, the process may be ended even if the process does not reach the n-th signal line.

In this case, when the difference between the energy of the signal of the estimated impulse response which is selected in specification of the parameter for a p-th signal line, and that of the signal of the estimated impulse response which is selected in specification of the parameter for a (p+1)-th signal line does not reach a predetermined threshold, the specifying portion 201 may end the process without performing specification of the parameter of a (p+2 (<n))-th signal line. Then, the signal lines subsequent to the (p+2)- or (p+1)-th signal line may be inactivated, so as not to be used in the correcting process.

According to the configuration, the throughput for the calculation performed in the specification of parameters in the specifying portion 201 can be reduced.

[Modification 4]

In the above-described embodiment, the low-pass filter 112 is disposed in the signal path in front of the delaying portion 113. Because the embodiment is configured by the cascade connection of the linear invariant system, the low-pass filter may be disposed in the signal path in rear of the delaying portion 113, so that the sequence is reversed. Namely, the low-pass filter 112 may be disposed in the signal path in front of the addition of the audio signal which is processed in the delaying portion 113 and the level adjusting portions 114-1, 114-2, . . . , 114-n, to the original audio signal which is input to the correction processing portion 102, in the adding portion 115.

In this case, for example, a second adding portion which once adds together the audio signals output from the level adjusting portions 114-1, 114-2, . . . , 114-n may be disposed, and an audio signal output from the second adding portion may be processed in the low-pass filter 112 and then supplied to the adding portion 115.

The low-pass filter 112 may not always be disposed because, in the environment where the position of the listener is not largely changed, the effect of reducing the influence of indirect sound is hardly lost even when the low-pass filter 112 is not disposed.

[Modification 5]

The control programs in the above-described embodiment can be provided in a state where they are stored in a computer-readable recording medium such as a magnetic recording medium (a magnetic tape, a magnetic disk, or the like), an optical recording medium (an optical disk or the like), a magnetooptical recording medium, or a semiconductor memory.

In the speaker apparatus 1, the control programs may be downloaded through the Internet.

[Modification 6] In the above-described embodiment, one parameter which satisfies predetermined requirements is specified from a plurality of parameters having different values for the respective signal lines. Alternatively, the specification may be performed by determining whether, instead of a plurality of parameters, one parameter satisfies predetermined requirements or not.

According to an aspect of the invention, it is possible to reduce the influence of indirect sound which is exerted on the sound quality, by using a configuration that is simpler than an FIR filter.

What is claimed is:

1. A method of setting a parameter for an audio apparatus, the audio apparatus including: a delay processing unit which applies a delaying process and an amplifying process on an input audio signal in accordance with the set parameter and which outputs a processed audio signal; and an adding unit which adds the audio signal output from the delay processing unit to the input audio signal and which outputs an added audio signal to an outputting device that outputs, as sound, the audio signal output from the adding unit, the method comprising:

performing a measuring process including:

causing the outputting device to output measurement sound; and measuring a first impulse response at a sound receiving point;

performing a specifying process including:

analyzing the measured first impulse response;

calculating a second impulse response at the sound receiving point when the outputting device outputs sound in case where a parameter is set in the audio apparatus and an audio signal indicative of the measurement sound is input to the audio apparatus; and specifying a parameter in accordance with the calculated second impulse response; and performing a setting process of setting the specified parameter in the delay processing unit.

2. The method according to claim 1, wherein, in the specifying process, a plurality of second impulse responses are calculated in case where a plurality of parameters, which have different values from each other, are respectively set in the audio apparatus, and one parameter is specified from the plurality of parameters in accordance with the plurality of second impulse responses.

3. The method according to claim 1, wherein the audio apparatus further includes an extracting unit which performs, to the audio signal which is to be added to the input audio signal, a process of extracting and outputting a component of a frequency band that is equal to or lower than a predetermined frequency band.

4. The method according to claim 1, wherein, in the specifying process, a parameter in which energy of the second impulse response in a predetermined period is smaller than energy of the first impulse response in the predetermined period is specified.

5. The method according to claim 1, wherein, in the specifying process, a parameter in which a peak value of an absolute value of the second impulse response in a predetermined period is smaller than a peak value of an absolute value of the first impulse response in the predetermined period is specified.

6. An audio apparatus comprising:

a delay processing unit that is configured to: i) apply a delaying process and an amplifying process on an input audio signal in accordance with a set parameter, and ii) output a processed audio signal; and an adding unit that is configured to: i) add the audio signal output from the delay processing unit to the input audio signal, and ii) output an added audio signal to an outputting device that outputs, as sound, the audio signal output from the adding unit, wherein the audio apparatus is configured to perform a measuring process in which:

the outputting device is configured to output a measurement sound; and a first impulse response at a sound receiving point is measured;

the audio apparatus is configured to perform a specifying process in which:

the measured first impulse response is analyzed;

a second impulse response at the sound receiving point is calculated substantially when the outputting device outputs sound in a case where a parameter is set in the audio apparatus and an audio signal indicative of the measurement sound is input to the audio apparatus; and a parameter in accordance with the calculated second impulse response is specified; and the audio apparatus is configured to perform a setting process of setting the specified parameter in the delay processing unit.

7. The audio apparatus according to claim 6, wherein, in the specifying process, a plurality of second impulse responses are calculated in case where a plurality of parameters, which have different values from each other, are respectively set in the audio apparatus, and one parameter is specified from the plurality of parameters in accordance with the plurality of second impulse responses.

8. The audio apparatus according to claim 6, further comprising:

an extracting unit that is configured to perform, to the audio signal which is to be added to the input audio signal, a process of extracting and outputting a component of a frequency band that is equal to or lower than a predetermined frequency band.

9. The audio apparatus according to claim 6, wherein, in the specifying process, a parameter in which energy of the second impulse response in a predetermined period is smaller than energy of the first impulse response in the predetermined period is specified.

10. The audio apparatus according to claim 6, wherein, in the specifying process, a parameter in which a peak value of an absolute value of the second impulse response in a predetermined period is smaller than a peak value of an absolute value of the first impulse response in the predetermined period is specified.

* * * * *